US007438365B2

(12) United States Patent
Kaiser et al.

(10) Patent No.: US 7,438,365 B2
(45) Date of Patent: Oct. 21, 2008

(54) MINING DEVICE

(75) Inventors: Manfred Kaiser, Oberschopfheim (DE); Thorsten Reich, Schwanau (DE); Thomas Studer, Kippenheim (DE); Peter Schmah, Kippenheim (DE)

(73) Assignee: Herrenknecht Aktiengesellschaft, Schwanau (DE)

( * ) Notice: Subject to any disclaimer, the term of this patent is extended or adjusted under 35 U.S.C. 154(b) by 0 days.

(21) Appl. No.: 11/510,880

(22) Filed: Aug. 28, 2006

(65) Prior Publication Data

US 2007/0046095 A1 Mar. 1, 2007

(30) Foreign Application Priority Data

Sep. 1, 2005 (EP) ..... 05019056

(51) Int. Cl.
*E21D 9/10* (2006.01)

(52) U.S. Cl. ..... 299/74; 299/77; 299/85.1

(58) Field of Classification Search ..... 299/74, 299/77, 78, 85.1
See application file for complete search history.

(56) References Cited

U.S. PATENT DOCUMENTS 475,833 A 5/1892 Wantling et al.
557,745 A * 4/1896 Wolfendale et al. ..... 299/77
1,116,354 A * 11/1914 Morgan ..... 299/77
4,035,024 A 7/1977 Fink et al.
4,486,050 A * 12/1984 Snyder ..... 299/18
5,308,151 A 5/1994 Sugden et al.

FOREIGN PATENT DOCUMENTS

FR 69 551 10/1958

OTHER PUBLICATIONS

Search Report issued for EPO application No. 05019056.
Patent Abstract of Japan, Japanese Publication No. 03262898.

* cited by examiner

*Primary Examiner*—John Kreck
(74) *Attorney, Agent, or Firm*—Welsh & Katz, Ltd.

(57) ABSTRACT

A mining device for subsurface extraction of raw materials off rocks includes bracing means for the reversible bracing of the mining device in a hollow space, a frame, and tunneling means stationarily connected with the bracing means, whereby the frame is movable by the tunneling means in a predefined direction. A rotatable roller is arranged on the frame, at the circumference of which cutting tools and clearing devices are arranged such that a rectangular mining cross-section can be created and such that the mining device and also the frame of the mining device is movable into a mining tunnel created by these cutting tools.

7 Claims, 2 Drawing Sheets

MINING DEVICE

FIELD OF INVENTION

The invention relates to a mining device according to the preamble of the independent claim 1.

Such mining devices, which comprise bracing means for the reversible bracing of the mining device in a hollow space, a frame and tunneling means stationarily connected with the bracing means, whereby the frame is movable in a predefined direction by the tunneling means, can be used for the subsurface extraction of raw materials consisting of rock or for the construction of tunnels.

BACKGROUND ART

In subsurface mining of rocks in mining, for extracting ores, gemstones or other raw materials, for example, the rock layers that are to be mined are typically made accessible via access tunnels or a network of access tunnels. Today, the actual mining mostly takes place by explosions in the rock layer that is to be mined and by subsequent removal of the mined material for triage and further utilization. Again and again, such explosions cause accidents and are thus subject to high safety requirements that are monitored regularly. Typically, for safety reasons the mining tunnels and the access tunnels are amply cleared, which involves major logistic efforts and completely interrupts the mining in phases. Furthermore, it is difficult to limit the extent of mining during explosions so that rock located adjacent to the rock layer to be mined is mined or that residues of the rock layer to be mined remain and are not mined.

Partly, mining devices with which the operating safety can be significantly improved, with which the number of interruptions of the mining can be considerably reduced, and with which the raw-material-containing rock layer can be more efficiently mined in a specific manner, i.e., ideally by including a rectangular mining cross-section, are also used today for the subsurface extraction of raw materials off rocks. For example, under product description ARM 1100, VOEST-ALPINE BERGTECHNIK markets a mining device comprising a frame on which a swivel arm is arranged that can be tunneled in relationship to a portion of the mining device wired with a tunnel. A rotating cutting disk having cutting disks arranged on its end face is arranged at the end of the swivel arm. During operation, the swivel arm is swiveled back and forth when the cutting wheel rotates, whereby the rock coming into contact with the cutting wheel is mined. On the one hand, an essentially rectangular mining cross-section can be created with the help of the swivel arm. However, a continuous mining over the entire mining cross-section is not possible with such a mining device, which limits the mining productivity.

It is thus the object of the following invention to propose a mining device that creates an essentially rectangular mining cross-section and allows for a continuous mining.

DISCLOSURE OF THE INVENTION

In particular, the mining device comprises bracing means for the reversible bracing of the mining device in a hollow space, a frame, and tunneling means stationarily connected with the bracing means, whereby the frame is movable in a predefined direction by the tunneling means. A rotating roller on the circumference of which cutting tools and clearing devices are arranged such that an essentially rectangular mining cross-section can be created is arranged on the frame and the mining device and, in particular also the frame of the mining device, can be moved in a mining tunnel created with these cutting tools. Such a mining device allows for a simple mining of rocks by including an essentially rectangular mining cross-section, which, inter alia, allow for a efficient specific mining of a raw-material-containing rock layer on the one hand, and, on the other hand, can create a tunnel that has an advantageous shape. Furthermore, during operation the roller of the mining device is essentially continuously in contact with the entire mining cross-section, which allow for a productive continuous mining. This mining device further allows for a moving of the frame with the tunneling means straight ahead as well as about a horizontal or vertical curve.

Preferably, at least one edge cutting tool is arranged on the circumference of the roller such that it projects above the roller in axial direction at least when the roller is in a rotational position in which the edge cutting tool is located on a side facing away from the bracing means. Typically, at least the frame of the mining device projects above the roller in its axial direction, which makes it impossible to shift the frame in the mining tunnel created by the mining device. However, with such edge cutting tools, the mining cross-section can be increased beyond the cross-section of the roller such that the frame and possible further subsequent devices can also be shifted in the created mining tunnels.

Advantageously, the at least one edge cutting tool is arranged such that it is unfolded in axial direction of the roller when the roller is in a rotational position in which the edge cutting tool is located on a roller on a side facing away from the bracing means and such that it is folded when the roller is in a rotational position in which the edge cutting tool is located on a side of the roller facing towards the bracing means. During operation, the edge cutting tool is unfolded in the rotational positions of the roller in which the edge cutting tool engages with the rock to be mined, whereby it can be accomplished that the mining cross-section is sufficiently large to permit a frame projecting above the roller to be shifted in the mining tunnels. Simultaneously, the edge cutting tool is folded in the rotational positions of the roller in which the edge cutting tool passes the frame, whereby it can be prevented that the edge cutting tool uncontrollably collides with the frame and affects the rotational movement of the roller.

In a first preferred variant of embodiment, two rollers are arranged in parallel, whereby the axis of rotation of the one roller is located in a line with the axis of rotation of the other roller. Such rollers make it possible to provide a relatively simple construction for providing a mining cross-section of a certain power. They can be arranged on a frame located in between as well as on a frame located outside. It is thereby particularly advantageous if at least the area of the mining cross-section between the rollers or away from the rollers, respectively, is increased with the above-described foldable edge cutting tools.

In a second preferred variant of embodiment, the mining device has two rollers, the sides of which facing one another are arranged at an acute angle such that the axes of rotation of the two rollers include an obtuse angle. During operation, the sides of the rollers facing towards the rock to be mined are maximally spaced apart from one another, while the sides of the rollers facing towards the tunneling means are minimally spaced apart from one another. Such a configuration of the rollers permits the use of edge cutting tools that are not foldable, while, simultaneously, providing a sufficiently large mining cross-section for shifting the frame and other devices into the mining tunnel.

Preferably, the two rollers thereby each have an edge cutting tool that projects above the corresponding roller in the direction of the other roller. Thus, a continuously defined mining cross-section can be achieved, particularly also in the region between the rollers.

The two rollers can each have at least one further edge cutting tool, which projects above the corresponding roller in the direction away from the other roller. An additional increase of the mining cross-section is thus made possible.

Advantageously, the cutting tools and the at least one edge cutting tool of the one roller are arranged alternatingly to the cutting tools and the at least one edge cutting tool of the other roller. With the above-described angled configuration of the two rollers each with at least one edge cutting tool projecting above the associated roller in the direction of the other roller it can thus be ensured that the said edge cutting tools of the one roller project above the other roller at the minimally spaced apart location of the two rollers, without colliding with cutting tools or edge cutting tools, respectively, of the other rollers.

Preferably, the two rollers can be rotated in the same direction, which allows for a simplified construction of the rotational drive of the rollers and allows for a simplified removal of the mining material.

The cutting tools and the at least one edge cutting tool can comprise cutting rolls. With such cutting rolls a high mining productivity can be warranted, even in hard rock.

BRIEF DESCRIPTION OF THE DRAWINGS

Further advantageous embodiments of the invention can be seen from the following description of exemplary embodiments of the invention with the help of the schematic drawings.

It is shown.

MODE(S) FOR CARRYING OUT THE INVENTION

Figure 1:
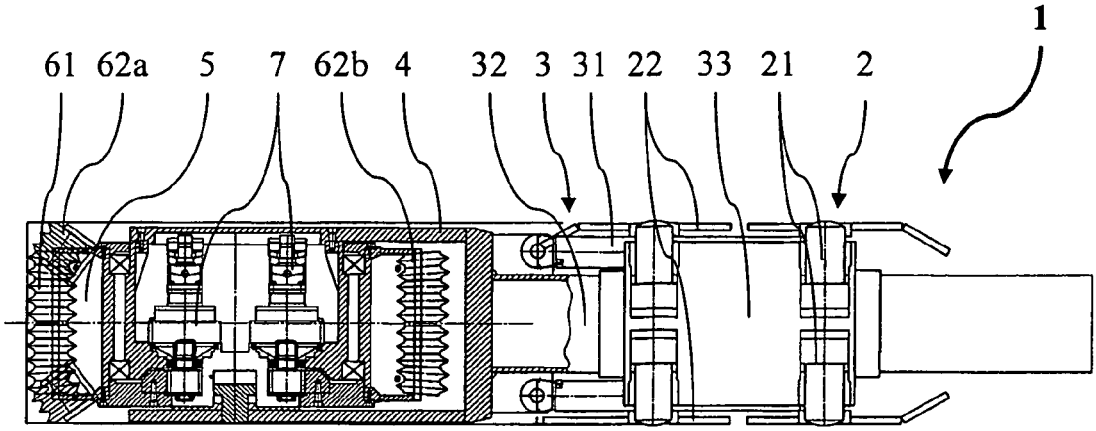
FIG. 1 a schematic cross-sectional view of a first exemplary embodiment of a mining device according to the invention with retracted tunneling means.

FIG. 1 shows a mining device 1 according to the invention with retracted bracing means 2, retracted tunneling means 3, and a roller 5 arranged on a frame 4. The bracing means 2 comprise bracing pressure cylinders 21 and gripper plates 22 and the tunneling means 3 comprise a tunneling pressure cylinder 31, a guide tube 32, and a guide housing 33. The roller 5 has cutting rolls 61 and clearing devices (not illustrated in FIG. 1) arranged on its circumference and foldable edge cutting rolls 62*a*, 62*b* arranged in its edge region. Typically, the cutting rolls 61 and the edge cutting rolls 62*a*, 62*b* are arranged offset to one another in axial direction of the roller 5 as well as in radial direction of the roller 5 (not apparent in FIG. 1). The roller 5 is rotatably positioned within the frame 4 by means of a rotational drive 7, the frame being embodied as an external frame partly surrounding the roller 5, whereby the end face of the roller 5 projects beyond the frame 4 in a tunneling direction. The frame 4 is fixedly connected with the guide tube 32 on the one hand, and with two tunneling pressure cylinders 31 arranged either above or below the guide tube 32 and parallel to the guide tube 32, on the other hand. The guide tube 32 is shiftably positioned in the guide housing 33 along the tunneling device. Four bracing pressure cylinders 21 are each stationarily connected with the external sides of the guide housing 33 (only one of the two external sides is visible in FIG. 1), and the bracing pressure cylinders 21 in turn are fixedly connected along their longitudinal ends with the gripper plates 22 that are arranged in parallel to the tunneling direction.

During operation, the roller 5 rotates about its axis of rotation, whereby it is operated by the rotational drive 7. When the roller 5 is in a rotational position in which the edge cutting rolls 62*a* are located at the end face of the roller 5, the edge cutting rolls are unfolded outwardly in axial direction of the roller 5 so that they project above the frame 4. When the roller 5 is in a rotational position in which the edge cutting rolls 62*b* are located within the frame 4, the edge cutting rolls 62*b* are folded so that they do not affect the rotational movement of the roller 5 and can pass the frame 4. The unfolding of the edge cutting rolls 62*a*, 62*b* can be implemented passively, for example with springs, and also particularly actively with its own mechanism.

The following predefinition applies for the entire further description. If, for the purpose of graphical clearness, a figure contains reference signs but they are not mentioned in the directly associated description text, reference is had to the explanation thereof in preceding figure descriptions.

Figure 2:
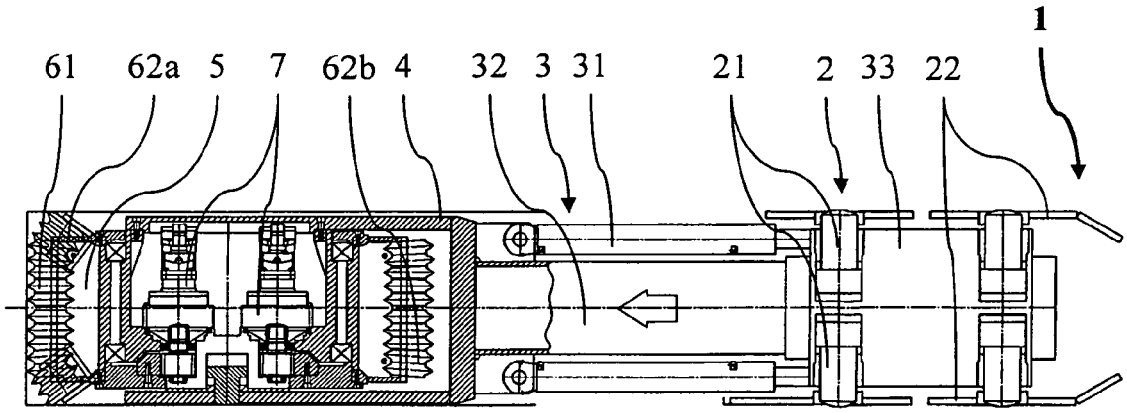
FIG. 2 a schematic cross-sectional view of the mining device of FIG. 1 with extended tunneling means.

FIG. 2 shows the mining device 1 with extended tunneling means 3. During operation, the bracing pressure cylinders 21 are extended prior to the extension of the tunneling means 3 and the gripper plates 22 are thus shifted in a direction vertical to the tunneling direction. The gripper plates 22 are thus pushed against the adjacent tunnel walls, thus fixedly bracing the mining device 1 in the tunnel. The rotating roller 5 transports the mining rock in tunneling direction, while the tunneling pressure cylinder 31 pushes the frame in tunneling direction. Due to the fact that the mining cross-section of the roller 5 is increased with the edge cutting rolls 62*a* and 62*b*, the frame 5 can be shifted in tunneling direction into the mining tunnel created by the roller 5 after detaching the bracing means 2. The mining material is cleared along the rotational direction of the roller 5 to one side of the mining device 1 with clearing devices arranged on the roller 5 (not visible in FIG. 2), from where it can be removed from the mining tunnel with a common conveying device (not visible in FIG. 2) for further processing.

Figure 3:
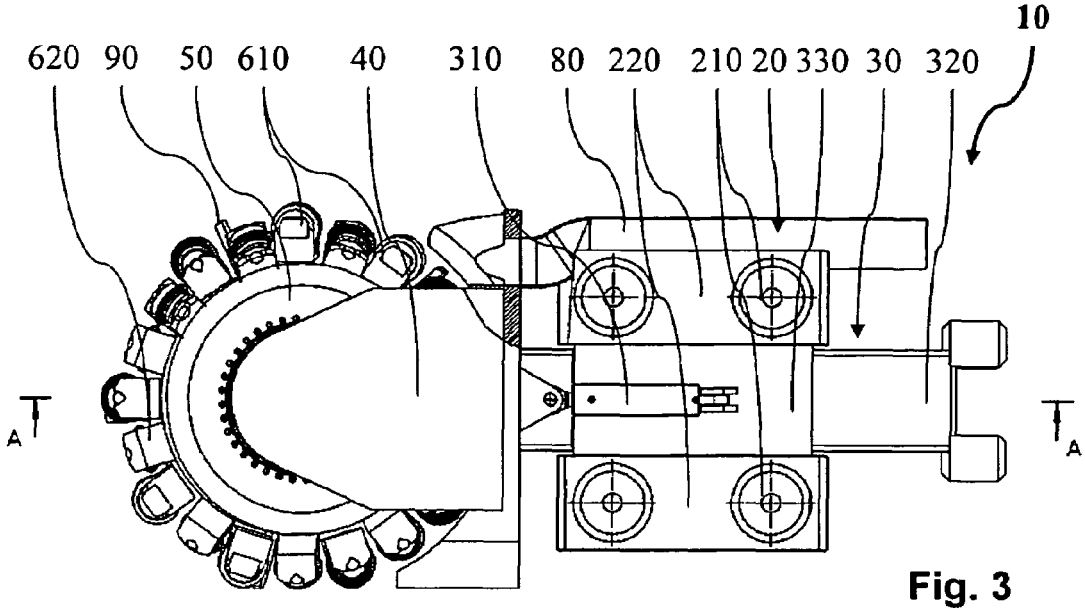
FIG. 3 a top view onto a second exemplary embodiment of a mining device according to the invention.
Figure 4:
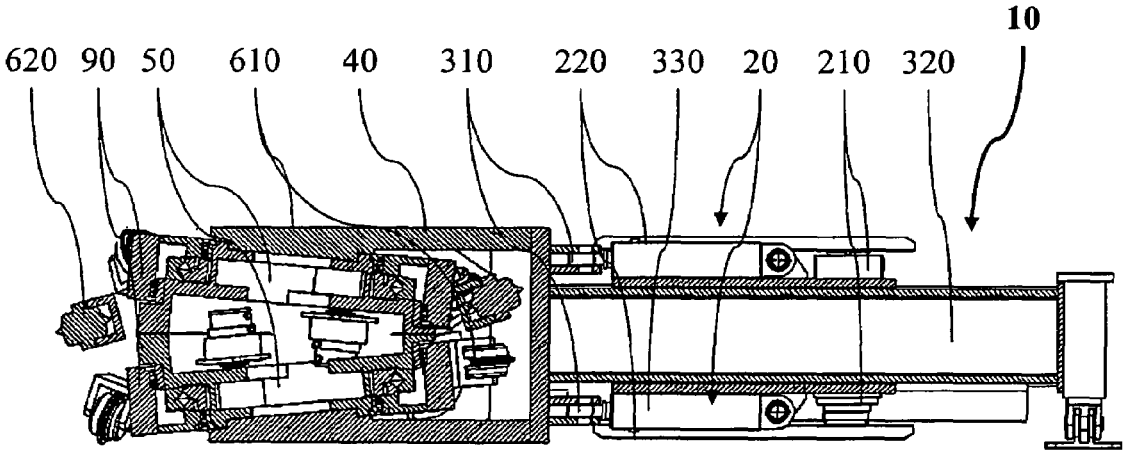
FIG. 4 a cross-sectional view of the mining device of FIG. 3 along line A-A.

FIG. 3 and FIG. 4 show a second exemplary embodiment of a mining device 10 according to the invention with bracing means 20, tunneling means 30 and two rollers 50 arranged on a frame 40. The bracing means 20 comprise bracing pressure cylinders 210 and gripper plates 220 and the tunneling means 30 comprise a tunneling pressure cylinder 310, a guide tube 320, and a guide housing 330. The rollers 50 are arranged towards one another at an acute angle in a V-shaped manner, whereby the greatest distance of the two rollers 50 is located in the region of their end faces. The rollers 50 each have cutting rolls 610 and clearing devices 90 arranged on their circumference and edge cutting rolls 620 in the edge region of the circumference, arranged towards the respective other roller 50. The cutting rolls 610 and the edge cutting rolls 620 are arranged on the respective roller 50 offset to one another in axial direction of the corresponding roller 50 and in radial direction of the corresponding roller 50. The rollers 50 are rotatably positioned within the frame 40 by means of a rotational drive, the frame being embodied as an external frame partly surrounding the roller 50, whereby the end face of the rollers 50 projects beyond the frame 40 in a tunneling direction. The frame 40 is fixedly connected with the guide tube 320 on the one hand, and with two tunneling pressure cylinders 310 arranged either above or below the guide tube 320 and parallel to the guide tube 320, on the other hand. The guide tube 320 is shiftably positioned in the guide housing 330 along the tunneling device. Bracing pressure cylinders 210 are stationarily connected with the external sides of the guide housing 330, and the bracing pressure cylinders 210 in turn are fixedly connected along their longitudinal ends with the gripper plates 220 that are arranged in parallel to the tunneling direction.

On the one hand, the V-shaped configuration of the two rollers 50 accomplishes that, during operation, the mining cross-section is large enough for the frame 40 of the mining device 10 to be tunneled into the mining tunnel created by the rollers and prevents, on the other hand, that foldable edge cutting rolls must be used. The edge cutting rolls 620 projecting above the rollers 50 each against the other roller 50 ensure that a continuous mining cross-section is achieved. To prevent that, in a rotational position of the rollers 50 in which they are located closest to one another, the edge cutting rolls 620 of the one roller 50 do not collide with the cutting rolls 610 or the clearing devices 90 of the other roller 50, the cutting rolls 610, the edge cutting rolls 620, and the clearing devices 90 of the one roller 50 are alternatingly arranged at a distance to the cutting rolls 610, the edge cutting rolls 620, and the clearing devices 90 of the other roller 50, so that they interlock in said rotational position without colliding. During operation, the mining material is cleared along the rotational direction of the roller 50 to one side of the mining device 1 with clearing devices 90 arranged on the rollers 50, from where it can be removed from the mining tunnel with a conveying device 80.

Further constructive variations can be realized for the above-described devices according to the invention. Expressly mentioned herein are also:

The mining device according to the first exemplary embodiment can also absolutely comprise a plurality and, in particular, two rollers arranged in parallel to one another.

Instead of the external frame, as it was described in the two above exemplary embodiments, the frame can also be embodied as an interior frame, whereby the frame is thereby arranged between the rollers.

Specific embodiments of a Mining Device according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

The invention claimed is:

1. Mining device comprising bracing means for reversibly bracing the mining device in a hollow space, a frame and tunneling means stationarily connected with the bracing means, whereby the frame is movable into a predefined direction by the tunneling means, wherein a rotatable roller is arranged on the frame, at the circumference of which cutting tools and clearing devices are arranged such that a rectangular mining cross-section can be created and such that the mining device and also particularly the frame of the mining device is movable into a mining tunnel created by these cutting tools and wherein at least one edge cutting tool is arranged on the circumference of the roller such that it projects above the roller in axial direction at least when the roller is in a rotational position in which the edge cutting tool is located on a side of the roller facing away from the bracing means and, wherein the at least one edge cutting is arranged such that it is unfolded in an axial direction of the roller when the roller is in a rotational position in which the edge cutting tool is located on a side of the roller facing away from the bracing means and that it is folded when the roller is in a rotational position in which the edge cutting tool is located on a side of the roller facing towards the bracing means; the mining device having two rollers being arranged in parallel, whereby the axis of rotation of the one roller is located in a line with the axis of rotation of the other roller.

2. Mining device comprising bracing means for reversibly bracing the mining device in a hollow space, a frame and tunneling means stationarily connected with the bracing means, whereby the frame is movable into a predefined direction by the tunneling means, wherein a rotatable roller is arranged on the frame, at the circumference of which cutting tools and clearing devices are arranged such that a rectangular mining cross-section can be created and such that the mining device and also particularly the frame of the mining device is movable into a mining tunnel created by these cutting tools and wherein at least one edge cutting tool is arranged on the circumference of the roller such that it projects above the roller in axial direction at least when the roller is in a rotational position in which the edge cutting tool is located on a side of the roller facing away from the bracing means and, the mining device having two rollers, the sides of which facing one another are arranged at an acute angle such that the axes of rotation of the two rollers include an obtuse angle.

3. Mining device comprising bracing means for reversibly bracing the mining device in a hollow space, a frame and tunneling means stationarily connected with the bracing means, whereby the frame is movable into a predefined direction by the tunneling means, wherein a rotatable roller is arranged on the frame, at the circumference of which cutting tools and clearing devices are arranged such that a rectangular mining cross-section can be created and such that the mining device and also particularly the frame of the mining device is movable into a mining tunnel created by these cutting tools and wherein at least one edge cutting tool is arranged on the circumference of the roller such that it projects above the roller in axial direction at least when the roller is in a rotational position in which the edge cutting tool is located on a side of the roller facing away from the bracing means and the mining device having two rollers, the sides of which facing one another are arranged at an acute angle such that the axes of rotation of the two rollers include an obtuse angle, wherein the two rollers each have an edge cutting tool that projects above the corresponding roller in the direction of the other roller.

4. The mining device according to claim 3, wherein the two rollers each have at least one further edge cutting tool that projects above the corresponding roller in the direction away from the other roller.

5. The mining device according to claim 3, wherein the cutting tools and the at least one edge cutting tool of the one roller are arranged alternatingly to the cutting tools and the at least one edge cutting tool of the other roller.

6. The mining device according to claim 1 wherein the two rollers are rotatable in the same direction.

7. Mining device comprising bracing means for reversibly bracing the mining device in a hollow space, a frame and tunneling means stationarily connected with the bracing means, whereby the frame is movable into a predefined direction by the tunneling means, wherein a rotatable roller is arranged on the frame, at the circumference of which cutting tools and clearing devices are arranged such that a rectangular mining cross-section can be created and such that the mining device and also particularly the frame of the mining device is movable into a mining tunnel created by these cutting tools and wherein at least one edge cutting tool is arranged on the circumference of the roller such that it projects above the roller in axial direction at least when the roller is in a rotational position in which the edge cutting tool is located on a side of the roller facing away from the bracing means and, wherein the cutting tools and the at least one edge cutting tool comprise cutting rolls.

* * * * *